United States Patent [19]

Lee et al.

[11] 4,318,713

[45] Mar. 9, 1982

[54] METHOD FOR GASIFYING CELLULOSIC MATERIAL

[75] Inventors: George T. Lee, West Allis; John N. Lees, Jr., Wauwatosa; Paul M. Pukita, Elm Grove, all of Wis.

[73] Assignee: Allis-Chalmers Corporation, Milwaukee, Wis.

[21] Appl. No.: 192,894

[22] Filed: Oct. 1, 1980

[51] Int. Cl.[3] ..... C10J 3/00

[52] U.S. Cl. ..... 48/203; 48/209

[58] Field of Search ..... 48/197 R, 203, 209; 201/2.5, 25, 33; 423/415 A

[56] References Cited

U.S. PATENT DOCUMENTS

| | | | |
|---|---|---|---|
| 1,270,949 | 7/1918 | Hornsey | 48/203 |
| 1,480,152 | 1/1924 | Cox | 202/100 |
| 1,564,730 | 12/1925 | Walden | 201/25 |

*Primary Examiner*—Peter F. Kratz

*Attorney, Agent, or Firm*—Lee H. Kaiser

[57] ABSTRACT

Method for gasifying cellulosic material comprises feeding cellulosic material into the uphill end of an inclined rotary kiln; transporting a bed of cellulosic material through the kiln and continuously tumbling the bed; withdrawing fuel gas from the uphill end of the kiln so it flows countercurrent to the bed and removes moisture in the drying zone and thermally decompose volatiles in the devolatilization zone; admitting air overbed in the devolatilization zone and only underbed in the gasifying zone; and controlling the mass flow rate of air into the devolatilization and gasifying zones respectively as predetermined percentages of that rate of which is stoichiometric to the cellulosic material fed into the kiln to thereby limit temperature rise, prevent agglomeration and minimize entrainment of solid particles. Air is admitted into the gasifying zone underbed through axially spaced sets of shell ports, and the mass flow rates of air therethrough are regulated as a function of the percentages of carbon in the bed in the portions of the kiln in which the sets of shell ports are disposed to thereby efficiently utilize the air in converting carbon into $CO_2$, assure that a high percentage of $CO_2$ is converted into chemical energy in the form of CO, and permit shortening of the kiln.

15 Claims, 3 Drawing Figures

METHOD FOR GASIFYING CELLULOSIC MATERIAL

BACKGROUND OF THE INVENTION

1. Field of the Invention

This invention relates to a method and apparatus for producing fuel gas from cellulosic material. In particular, the invention relates to gasification of cellulosic material such as wood by pyrolysis in a rotary kiln.

2. Description of the Prior Art

A method and apparatus for making producer gas from carbonaceous material such as inferior grades of coal, wood waste or peat are disclosed in such prior art patents as U.S. Pat. No. 1,267,410 and 1,270,949 to Hornsey and U.S. Pat. No. 1,480,152 to Cox, wherein carbonaceous material is fed into the uphill end of an inclined rotary kiln; the carbonaceous material is repeatedly elevated by lifting buckets and showered downwardly as it is advanced through the kiln to dry the material and distill volatiles therefrom; air and/or steam is fed into the interior of the kiln through ports in the end walls and/or cylindrical walls to oxidize the carbonaceous material as it is being showered; and the resulting gases are withdrawn from one or both ends of the kiln. The carbonaceous material is diffused and distributed throughout the kiln by the lifting buckets as air is admitted from the ends of the kiln in such prior art apparatus with the result that oxygen and a substantial amount of solid particulates are entrained in the fuel gas, the characteristics of the fuel gas are inconsistent, and scrubbing equipment is required to clean the gas. The diffused carbonaceous material is oxidized throughout the kiln by the oxygen in the air or steam admitted into the kiln of such prior art apparatus with the result that the temperature of the carbonaceous material and carbon gases becomes so high due to the heat generated by the exothermic oxidizing reaction ($C+O_2 \rightarrow CO_2$) that slagging occurs with consequent formation of "rings" of agglomerated material that impair transport of the material through the kiln and necessitate introduction of steam into the kiln to moderate the temperature rise. Due to the diffused scattered condition of the carbonaceous material, the oxygen in the admitted air or steam is not utilized efficiently in converting the carbon in the material to carbon gases, thereby necessitating an extremely long kiln in order to convert fully the carbon in the solid material to gas. Also, most prior art rotary kins, including those of the calcining, roasting and reducing types, are hundreds of feet in length and, consequently, have been expensive to construct.

Prior art patents such as U.S. Pat. No. 775,693 to Williams and U.S. Pat. No. 1,216,667 and U.S. Pat. No. 1,279,949 to Downs disclose admitting air under a bed of material being transported through a rotary kiln, but such prior art patents disclose injecting air under high pressure into the kiln to agitate and radially distribute the solid material, and consequently the above-discussed disadvantages would result if the apparatus of these prior art patents were used for the gasification of cellulosic material.

OBJECTS OF THE INVENTION

It is an object of the invention to provide an improved method and apparatus for gasifying cellulosic material which produce a clean fuel gas having high chemical energy in the form of carbon monoxide and other combustibles in which minimum solid particulates are entrained and do not necessitate scrubbing equipment in order to meet environmental protection regulations.

A further object of the invention is to provide an improved method and rotary kiln apparatus for gasifying cellulosic material which tumble and transport a quiescent and stable packed bed of cellulosic material through the kiln so that minimum solid particulates are entrained in the fuel gas and the characteristics of the fuel gas are consistently uniform.

It is a further object of the invention to provide an improved method and apparatus for gasifying cellulosic material which do not require introduction of steam into the kiln in order to fully oxidize the carbon in the bed of cellulosic material and moderate the temperature rise within the kiln.

Another object is to provide an improved method and apparatus for gasifying cellulosic material wherein the rotary kiln can be of shorter axial length, and thus comparatively lower cost, than prior art apparatus. A further object is to provide such improved method and apparatus which limit the temperature rise of the bed of cellulosic material and the overbed gases resulting from oxidizing the carbon in the cellulosic material and minimize slagging and formation of "rings" of agglomerated material within the kiln. Still another object is to provide such improved method and apparatus which limit the temperature rise within the kiln and also efficiently utilize the air admitted into the kiln to oxidize the carbon in the cellulosic material, thereby permitting substantial reduction in the ported length of the kiln.

A further object is to provide an improved method and rotary kiln apparatus for gasifying cellulosic material which tumble and transport a stable packed bed of cellulosic material through the kiln and admit portions of the air required to oxidize the carbon in the cellulosic material underbed in the gasifying zone and overbed in the devolatilization zone to thereby provide continuous mixing and uniform temperature throughout the bed with consequent elimination of slagging. A still further object is to provide such improved method and apparatus which have a high extent of conversion of carbon dioxide into carbon monoxide and regulate the air admitted into the kiln as a function of the rate that cellulosic material is fed into the kiln for the purpose of maintaining a stable bed, preventing entrainment of solid particulates in the fuel gas, controlling the temperature rise of the bed, and efficiently utilizing the oxygen in the admitted air to convert the carbon in the cellulosic material into carbon dioxide and in converting a high percentage of the carbon dioxide into chemical energy in the form of carbon monoxide and other combustibles, thereby permitting the length of the kiln to be shortened. Still another object is to provide such improved method and apparatus which regulate the mass flow rates of air into different axially spaced portions of the gasifying zone as a function of the percentages of carbon in the cellulosic material in such axially spaced portions to thereby assure that the admitted air is efficiently utilized in converting the carbon into carbon dioxide and that a high percentage of carbon dioxide is converted into chemical energy in the form of carbon monoxide.

SUMMARY OF THE INVENTION

The method of the invention converts cellulosic material into a clean fuel gas having high chemical energy in the form of carbon monoxide and other combustibles and minimum solid particulates entrained therein by the steps of continuously feeding the cellulosic material into the uphill end of an inclined rotary kiln having at least drying, devolatilization and gasifying zones of successively increasing temperature from the feed end to the discharge end of the kiln; rotating the kiln so that a packed stable bed of the cellulosic material is tumbled continuously as it advances downwardly within the kiln; withdrawing the gases generated within the kiln from the uphill end so that they flow countercurrent to and in heat exchange relation with the cellulosic material bed to dry it in the drying zone and thermally decompose the volatiles in the devolatilization zone; admitting air into the kiln: (a) above the bed in the devolatilization zone to raise the temperature of the overhead gases and enhance distillation of the volatiles, and (b) into the gasifying (also termed "gasification") zone only under the bed and through a limited flow arc so that the oxygen in the admitted air reacts with carbon in the cellulosic material to effect relatively complete conversion of the cellulosic material into gas; and regulating the flow of admitted air so that the resulting gases rising through the bed in the gasifying zone do not blow solid particles away from the bed surface and cause entrainment thereof in the fuel gas. The air regulating step limits the mass flow rate of air overbed into the devolatilization zone and underbed into the gasifying zone as a function of the rate that cellulosic material is fed into the kiln and, together with the continuous mixing as a result of tumbling, controls the temperature rise of the cellulosic material and overbed gases in the gasifying zone caused by the exothermic oxidizing ($C+O_2 \rightarrow CO_2$) reaction, thereby minimizing slagging and agglomeration and avoiding the necessity of admitting steam to moderate the temperature within the bed, while still providing maximum conversion of carbon in the cellulosic material into chemical energy in the form of carbon monoxide and other combustibles. Preferably, the air regulating step admits air at a mass flow rate which is less than a predetermined percent of the mass flow rate of air stoichiometric to the cellulosic material fed into the kiln.

Air is admitted into the gasifying zone through circumferentially spaced shell ports arranged in axially spaced sets, and the mass flow rate of air through the axially spaced sets of shell ports is preferably regulated as a function of the percentage of carbon in the cellulosic material in different axially spaced portions of the kiln so that the flow rate is higher through the uphill ports than through ports adjacent the discharge end of the kiln. This provides a greater amount of air to react with the fresh char in the cellulosic material at the entrance to the gasifying zone where the percentage of carbon is highest, and lesser amounts of air as mass is removed from the bed and the carbon particles get smaller and are converted to ash as they advance toward the discharge end of the kiln. Such regulation of admitted air provides a quiescent and stable packed tumbled bed; controls the temperature rise of the bed and the overbed gases; avoids a significant amount of solid particulates in the fuel gas; produces a fuel gas having consistently uniform characteristics; minimizes agglomeration, and efficiently utilizes the admitted air in converting the carbon in the cellulosic material into carbon dioxide and a high percentage of carbon dioxide into chemical energy in the form of carbon monoxide so that the ported length of the kiln can be shortened to approximately $1\frac{1}{2}$ to 3 times its diameter.

BRIEF DESCRIPTION OF THE DRAWINGS

The above and other objects and advantages of the invention will become more apparent from consideration of the following detailed description when read together with the accompanying drawing wherein.

DETAILED DESCRIPTION

Figures 1, 2:
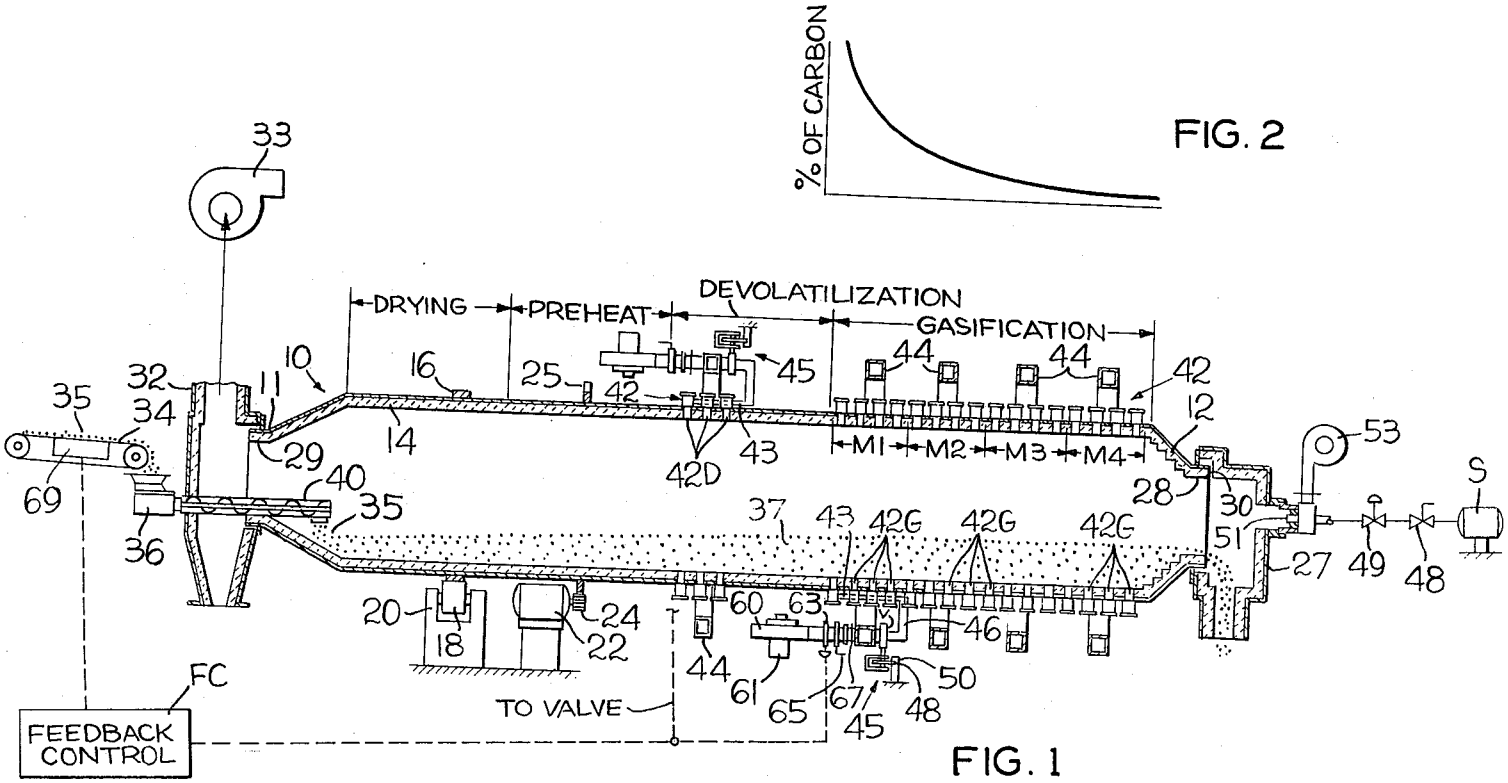
FIG. 1 is a schematic cross sectional view taken axially through rotary kiln apparatus embodying the invention.
FIG. 2 is a graph showing the variation in the percentage of carbon in the cellulosic material bed as it advances through the gasifying zone.

Referring to FIG. 1 of the drawing, apparatus embodying the invention has an elongated cylindrical rotary vessel, or rotary kiln 10 with its axis inclined slightly from the horizontal from its uphill intake, or feed end 11 to its downhill discharge end 12. The wall 14 of rotary vessel 10 may be constructed of suitable refractory material such as firebrick. A pair of axially spaced annular girth rings 16 (only one being shown) provided about the circumference of rotating vessel 10 may be supported on wheels 18 (only one being shown) rotatably contained in conventional journal bearings 20 (only one being shown). Vessel 10 may be rotated by any suitable means shown as including an electric motor 22 which is provided with a driving gear 24 that meshes with a girth gear 25 connected to and surrounding rotary vessel 10. A stationary end piece 27 at the discharge end 12 of rotary vessel 10 has an opening aligned with discharge opening 28 in vessel 10 so that ash residue can be discharged from the kiln. Rotary vessel 10 has a radially inwardly extending annular flange 30 adjacent discharge end 12 which defines discharge opening 28 and forms a dam to enable the desired bed depth to be achieved.

The uphill feed end 11 of rotary vessel 10 registers with an opening in the wall of a vertical stack 32 with a suitable seal therebetween to permit rotation of vessel 10. A power driven blower 33 connected to stack 32 withdraws gases generated within rotary vessel 10 through intake opening 29 at feed end 11. A belt conveyor 34 transports cellulosic material 35 to a feed hopper 36 which registers with a screw auger 40 that projects through an opening in the wall of stack 32 and extends through intake opening 29 so that cellulosic material 35 may be continuously fed at a controlled rate into the kiln 10 by screw auger 40 while gases are simultaneously being withdrawn from the uphill feed end 11 of the kiln through feed opening 29 and into stack 32 by blower 33. The hot fuel gas withdrawn through feed opening 29 is a non-equilibrium mixture of carbon dioxide, carbon monoxide, water vapor, hydrogen, methane and other hydrocarbons, alcohols, partially-oxidized hydrocarbons and nitrogen.

Figure 3:
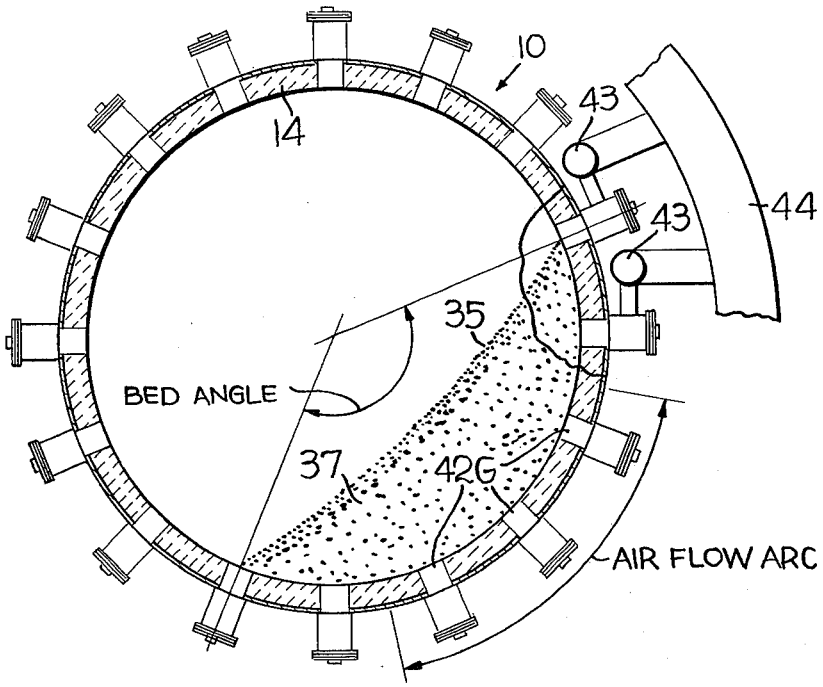
FIG. 3 is a schematic cross sectional view taken radially through the rotating kiln and showing the bed of cellulosic material in the apparatus of FIG. 1.

Motor 22 may slowly rotate vessel 10 so that the packed bed 37 of cellulosic material 35 within vessel 10 occupies a segment of the vessel radial cross section, as represented in FIG. 3, and advances slowly downward from the uphill feed end 11 to the downhill discharge end 12 and is continuously tumbled as it is transported. The or bed angle of the cellulosic material 35 subtended at the kiln axis by such segment is a function of the depth of bed 37 and the speed of kiln rotation. Vessel 10 may define drying, preheat, devolatilization (or distillation) and gasifying zones in seriatim which successively increase in temperature from its uphill feed end 11 to its downhill discharge end 12.

In accordance with the invention, air is admitted: (a) into the gasifying zone only underneath the cellulosic material bed 37 and (b) overbed into the devolatilization zone, and the mass flow rate of air so admitted is regulated as a function of the rate that cellulosic material 35 is fed into the kiln. Such steps, together with the continuous mixing of the cellulosic material as the result of tumbling, minimizes the solid particulates in the fuel gas; provides a stable packed bed 37; controls the temperature rise of bed 37 and overbed gases in the gasifying zone and results in substantially uniform temperature throughout bed 37; substantially eliminates slagging; efficiently utilizes the air admitted into the kiln in converting carbon in the cellulosic material into gaseous products; results in a high extent of conversion of carbon dioxide into carbon monoxide; and permits the ported length of the kiln to be shortened in comparison to prior art apparatus. Air may be admitted into the devolatilization zone overbed through axially disposed conduits, termed centerline ports of the type disclosed in the aforementioned Hornsey patents or the type disclosed in U.S. Pat. No. 1,916,900. However, preferably air is admitted into the gasifying zone and into the devolatilization zone through a plurality of circumferentially and axially spaced shell ports, or nozzles 42 projecting radially through the kiln shell. Such shell ports 42 are well known and are disclosed in aforementioned U.S. Pat. No. 1,267,410 and in U.S. Pat. No. 1,760,078 and U.S. Pat. No. 2,344,440. Shell ports 42 provided about the surface of vessel 10 may be constructed in accordance with U.S. Pat. Nos. 3,784,107 or 3,946,949 having the same assignee as this invention, and the details thereof are omitted from the drawing and detailed description. A plurality of circumferentially spaced air conduits 43 extending parallel to the kiln axis may be supported about the surface of vessel 10, and a plurality of annular air manifolds 44 may surround and be mounted on kiln 10 to deliver air to conduits 43. Air distribution means 45, similar to the type disclosed in U.S. Pat. Nos. 3,945,624, 3,847,538 or 3,794,483, having the same assignee as this invention and described in detail hereinafter may connect air conduits 43 to the associated shell ports 42. However, in accordance with the invention, air flow distribution means 45 regulates the mass flow rate of air through shell ports 42 as a function of the rate that cellulosic material 35 is fed into vessel 10, and also regulates the mass flow rate of air through axially spaced ports 42G into the gasifying zone as a function of the percentage of carbon in the cellulosic material 35 in the portion of the bed 37 above the shell ports 42G. The shell ports registering with the gasifying and devolatilization zones respectively are designated 42G and 42D, and air distributing means 45 permits: (a) air to flow through shell ports 42G into the gasifying zone only when the shell ports 42G are beneath bed 37 and interrupts the flow of air therethrough when they are no longer beneath the bed; and (b) air to flow through shell ports 42D when they are above bed 37 and interrupts the flow of air therethrough when ports 42D are beneath bed 37. Air distribution means 45 also regulates the admission of air through shell ports 42G into the gasifying zone so that air flow is not initiated until the cellulosic material exiting the devolatilization zone has reached the temperature at which it will ignite upon contact with oxygen in the air admitted into the gasification zone; hereinafter referred to as "spontaneous ignition temperature."

In starting the kiln, an external fuel such as gas from any suitable source S is fed under pressure through an on-off valve 48 and a pressure regulating valve 49 to a jet 51 directed axially into discharge opening 28 in vessel 10, and the external fuel is mixed with air from a pump 53 and burned in jet 51 to preheat kiln 10. The refractory material 14 of the kiln and the cellulosic material bed 37 may be heated by external fuel jet 51 until the cellulosic material adjacent the exit from the devolatilization zone is above its spontaneous ignition temperature.

Cellulosic material 35 fed into kiln 10 by screw auger 40 typically may be raw wood residue known in the paper industry as "raw hog fuel" in which approximately 80% of the particles are less than $\frac{5}{8}$ inch diameter and have a moisture content in the range of 35% to 50% on a wet basis. Cellulosic material 35 enters vessel 10 at atmospheric temperature and gathers in bed 37 at the bottom of the rotating vessel 10 within the drying zone and tends to move circumferentially upward with the ascending side of the rotating vessel until the bed surface reaches and exceeds its normal angle of repose, as shown in FIG. 3, whereupon the particles on the bed surface tumble by gravity so that they are continuously mixed with those from the bed interior and maximum surface area of the particles is exposed to the overbed gases. The bed 37 of cellulosic material occupies a segment of the circular kiln cross section, as shown in FIG. 3, which depends upon the bed depth, and air is only admitted by air distribution means 45 through shell ports 42G into the gasifying zone when shell ports 42G are within an air flow arc, shown in FIG. 3, that subtends a smaller angle at the kiln axis than the bed angle at said axis subtended by the segment of the kiln cross section which bed 37 occupies. FIG. 3 illustrates that in each of a plurality of radial planes through the gasifying zone sixteen arcuately spaced shell ports 42G are provided around the circumference of vessel 10. Such angular pitch between shell ports 42G in the same radial plane provides plural shell ports simultaneously disposed within the air flow arc which can be open to admit air beneath bed 37, thereby permitting the admitted air and resultant gases to rise approximately uniformly through the bed 37, in comparison to a kiln wherein air is admitted through a single port, and contributing to the formation of a quiescent and stable bed and to uniform properties in the fuel gas.

As vessel 10 rotates, bed 37 advances slowly toward the discharge end 12 due to the combined effects of the tumbling action, gravity and the inclination of vessel 10. Initially upon starting the kiln, moisture is evaporated from the cellulosic material 35 within the drying zone as a result of the heat from the flame of external fuel jet 51, but in normal kiln operation water is evaporated from the cellulosic material 35 in the drying zone by the heat exchange between the cellulosic material bed 37 and the counterflow of hot overbed gases being withdrawn through feed opening 29 by blower 33. Although cellulosic material 35 in the drying zone is in heat exchange relation with the countercurrent hot gases, its temperature rises very slowly due to heat of vaporization as moisture is evaporated, and cellulosic material 35 exits the drying zone at a temperature of approximately 100° C. Preferably, the axial length of the drying zone is equal to approximately twice the diameter of vessel 10.

From the drying zone, bed 37 enters the preheat zone where cellulosic material 35 is also in heat exchange relation with the overhead gases, which flow countercurrent to bed 37, and steadily rises in temperature until distillation of volatiles from the cellulosic material begins. The preheat zone provides a transition temperature range in which any moisture remaining in cellulosic material 35 is driven off.

As cellulosic material 35 moves into the devolatilization zone, or distillation zone, mass is removed from the cellulosic material bed 37 and transferred to the overbed gases as a result of thermal decomposition of low devolatilization temperature hydrocarbons (such as methane and ethylene) and partially oxidized hydrocarbons (for example, methanol, other alcohols and aldehydes) in the cellulosic material 35. Such thermal decomposition and distillation of volatiles is the result of heat exchange between the high temperature overbed gases from the gasifying zone (such as CO, $CO_2$, $H_2$, $N_2$ and water vapor) and the cellulosic material bed 37 which move in opposite directions. A mixture of low molecular weight hydrocarbon gases and partially oxidized hydrocarbon gases is distilled from the cellulosic material 35 in the devolatilization zone and mixes with the high temperature off-gas from the gasifying zone. The volatiles distilled from bed 37 react with the high temperature off-gas from the gasifying zone in numerous re-forming and decomposition reactions, and the products of such reactions are carbon monoxide, hydrogen, and lower-molecular weight hydrocarbon gases. The temperature of the overbed gases is reduced in the distillation zone as a result of conversion of sensible heat to stored chemical energy accompanying such reactions and also as a result of the simultaneous heat exchange with the solid cellulosic material 35 in bed 37.

Such distillation and chemical reactions in the devolatilization zone do not raise the cellulosic material 35 to a sufficiently high temperature, and sufficient air is admitted into the interior of vessel 10 above the bed 37 in the devolatilization zone to support partial combustion of the overbed hydrocarbon gases and volatiles and raise the temperature of cellulosic material 35 exiting the devolatilization zone above its spontaneous ignition temperature of approximately 700° F. Preferably such air is admitted overbed in the devolatilization zone by air distribution means 45 through a plurality of circumferentially and axially spaced nozzles, or shell ports 42D which are open when they are above bed 37 and are closed to interrupt air flow therethrough when they are beneath bed 37. To the extent permitted by the oxygen content of the air admitted through ports 42D, the gases are burned, being well above their ignition temperature, and this supplies the additional heat required to bring the cellulosic material 35 exiting the distillation zone above its spontaneous ignition temperature. This process in the distillation zone is self-sustaining, and the external fuel source may be shut off by closing valve 48. A devolatilization zone whose axial length is approximately equal to its diameter is adequate to raise the temperature of the cellulosic material 35 from approximately 200° F. at the exit from the drying zone to approximately 700° F. at the exit from the devolatilization zone.

Shell ports 42D (not shown) may, if desired, be also provided to admit air above bed 37 in the drying and preheat zones. The mass flow rate of air (for example, pounds of air per minute) through shell ports 42D into the devolatilization and/or preheat and/or drying zones within vessel 10 is regulated by air distributing means 45 as a function of the rate that cellulosic material is fed into vessel 10, and preferably is regulated to be less than a predetermined percentage, namely approximately 23 percent; of that mass flow rate of air which is stoichiometric to the cellulosic material 35 and so that approximately 50 percent of the total air required to convert the carbon in cellulosic material 35 is used overbed in the devolatilization and drying zone. In normal operation of kiln 10, the mass flow rate of air through shell ports 42D into the devolatilization, preheat and/or drying zones is regulated to be approximately 15 percent of that mass flow rate of air which is stoichiometric to the cellulosic material 35 fed into vessel 10. Introduction of a portion of the air admitted into vessel 10 above bed 37 through shell ports 42D: (1) prevents the cellulosic material 35 from being heated to excessively high temperatures in the gasifying zone (as would occur if all the air required to convert the carbon were admitted underbed into the gasifying zone through ports 42G) thereby limiting the temperature rise of bed 37 and of overbed gases in the gasifying zone; (2) raises the temperature of the overbed gases to provide sensible heat energy to effect evaporation of water in the cellulosic material 35 fed into the drying zone; and (3) permits the ported length of the gasifying zone to be substantially shortened in comparison to that theoretical length which would be necessary to fully convert the carbon in bed 37 to carbon dioxide and to keep the solid cellulosic material 35 particles in bed 37 from being blown away from the surface of the bed if all the air were admitted underbed in the gasifying zone.

The charred cellulosic material in bed 37 entering the gasifying zone is above its ignition temperature and consists primarily of solid carbon particles, cellulosic material containing high temperature volatiles, and ash. Air is admitted through shell ports 42G into the gasifying zone to effect relatively complete conversion of carbon in the cellulosic material to gas, but air is admitted through shell ports 42G only beneath bed 37 and the mass flow rate of air so admitted is regulated as a function of the feed rate of cellulosic material 35 into the kiln for the purpose of limiting the temperature rise of bed 37 and the overbed gases within the gasifying zone, minimizing slagging and entrainment of particles in the fuel gas, and utilizing the oxygen in the air efficiently in converting the carbon to carbon dioxide, thereby permitting substantial shortening of the gasifying zone. Air distribution means 45 preferably limits the mass flow rate of total air admitted into said kiln to a maximum of approximately 46 percent of that mass flow rate of air which is stoichiometric to the rate said cellulosic material is fed into said kiln and regulates the mass flow rate of said total air to normally be approximately 30 percent of said stoichiometric rate.

The mass flow rate of air through shell ports 42G into the gasifying zone is preferably limited to a predetermined maximum percentage, namely approximately 23 percent, of that air mass flow rate which is stoichiometric to the feed rate of cellulosic material 35 into kiln 10 and so that approximately 50 percent of the total air required to convert the carbon is cellulosic material 35 is used underbed in the gasification zone. In normal operation of kiln 10 such mass flow rate of air into the gasifying zone is regulated to be approximately 15 percent of that rate which is stoichiometric to the cellulosic material. This step of so regulating mass flow rate of air admitted underbed into the gasifying zone, together with the continuous tumbling of the cellulosic material: (a) limits the temperature rise of the cellulosic material 35 in the gasifying zone as a result of the exothermic $C+O_2$ $CO_2$ reaction and consequently limits the temperature rise of the overbed gases and minimizes slagging within the gasifying zone; and (b) limits the superficial velocity at which the resulting gases rise through bed 37 so that they do not blow solid particles away from the bed surface and entrain them in the overbed gases (where superficial velocity is defined as the mass flow rate of gasification air per unit bed surface area divided by the mass density of the gasification air calculated at the temperature and pressure at which the gasification air enters the bed).

As air leaves shell ports 42G, the oxygen in the air reacts with the hot carbon char, which is above its ignition temperature, and converts chemical energy into sensible heat in a $C+O_2 \rightarrow CO_2$ exothermic reaction whose products are carbon dioxide and heat energy. Substantially all of the free oxygen in the admitted air is converted into carbon dioxide. Once the amount of oxygen falls to a negligible level, the carbon dioxide reacts with the hot carbon char in an endothermic reaction ($CO_2+C \rightarrow 2CO$) to produce carbon monoxide. Such endothermic reaction is accompanied by conversion of sensible heat to chemical energy in the form of carbon monoxide and a consequent reduction of the temperature of the product gases and of bed 37, thereby limiting the temperature rise of the cellulosic material 35 and also of the overbed gases within the gasifying zone while still permitting relatively complete conversion of the carbon in the cellulosic material to gas.

The temperature in the small oxidation area near the face of ports 42G where the exothermic $C+O_2 \rightarrow CO_2$ reaction occurs could approach 4000° F. and could result in excessive heating of the solid cellulosic material 35 in bed 37 if admission of air into the interior of vessel 10 were uncontrolled, or if all the air were introduced into the gasifying zone. Admission of air from the ends of the kiln, in the manner taught by the aforementioned prior art patents, could result in entrainment of oxygen in the fuel gas, inconsistent characteristics in the fuel gas, and heating of the solid material bed to excessively high temperatures with consequent agglomeration and slagging in the interior of the kiln. Further, admission underbed in the gasifying zone of all air necessary to oxidize the carbon in the cellulosic material could result in high velocities of the resultant gases rising through the bed, which velocities would blow solid particles away from the bed surface and would necessitate a very long kiln to convert all the carbon in the cellulosic material to carbon dioxide.

Shell ports 42G are preferably arranged in axially spaced sets, and the mass flow rate of air through such axially spaced sets of shell ports 42G is regulated as a function of the percentages of carbon in cellulosic material 35 in axially spaced apart portions of the gasifying zone so that a greater amount of air is available at the uphill entrance end of the gasifying zone to react with the carbon in the cellulosic material, where the cellulosic material is rich in fresh char and lean in ash, and lesser amounts of air are available to react with the carbon in a direction toward the discharge end 12 of the kiln 10 as the carbon particles become smaller and more of the fresh char removed from the bed as gas. FIG. 2 graphically illustrates how the relative percent of carbon in cellulosic material 35 may typically vary as bed 37 is transported through the gasifying zone, and it will be appreciated that regulation of the mass flow rates of air through the axially spaced sets of shell ports 42G as a function of such percentages of carbon efficiently utilizes the oxygen in the admitted air in converting the carbon in the cellulosic material into gaseous products rich in carbon monoxide and lean in carbon dioxide. Typically the ash exiting from kiln 10 through discharge opening 28 has a mass in the range of from zero to 5 percent of that of the cellulosic material 35 fed into kiln 10.

The axial length of the gasifying zone is preferably approximately twice the diameter of vessel 10 and is divided into four similar axially displaced sets of shell ports 42G, or modules shown as M1, M2, M3 and M4, each module having an axial length of approximately one-half the diameter of vessel 10. Air distribution means 45 selectively control the mass flow rates of air admitted through shell ports 42G in modules M1, M2, M3 and M4. Typically, air distribution means 45 regulates the mass flow rates of air so that 40%, 30%, 20% and 10% of the total air admitted into the gasifying zone flows, respectively, through the shell ports 42G in modules M1, M2, M3 and M4. Such regulation of mass flow rates of air in a typical kiln could correspond to gases flowing upward through bed 37 in the respective modules M1, M2, M3, M4 at superficial velocities of approximately 25, 19, 13 and 6 feet per minute. Such controlled velocities of flow of gases upward through bed 37 results in the available carbon in the cellulosic material 35 being converted into carbon dioxide in local oxidation areas immediately adjacent the faces of shell ports 42G, and the resultant carbon dioxide to be subsequently converted in an endothermic reaction into carbon monoxide, and thereby cool the bed, as the gases rise at controlled velocities through the upper portion of bed 37. Further, the gases rise through bed 37 at velocities which are insufficient to blow solid particles away from the bed surface and entrain them in the overbed gases. The continuous mixing as a result of tumbling of bed 37 quickly removes heat from such local oxidation zones near the faces of ports 42G so that the potential for extremely high temperature in such local oxidation zones is of short duration, thereby effecting approximately uniform temperature throughout bed 37 within the gasifying zone and accomplishing relatively complete conversion of the carbon in the cellulosic material to gas. Preferably air distribution means 45 regulates the mass flow rate of air through shell ports 42G so that the maximum superficial velocity of gas moving upward through bed 37 is approximately 30 feet per minute (fpm). Tests establish that gases rising upwardly through the bed 37 of superficial velocities significantly higher than 30 fpm (e.g., 40 fpm) result in a disrupted and unstable bed with solid particles of all sizes entrained above the bed where they can be transported out of the kiln and appear in the output gas. The tests further establish that within such superficial velocity parameters substantial conversion of $CO_2$ to CO occurs as indicated by ratios of $CO/(CO+CO_2)$ in the bed off-gas being in the range from 60% to 90%.

Air distribution means 45 includes a plurality of annular manifolds 44 affixed to and encircling vessel 10, one manifold 44 being provided for each module M1, M2, M3 and M4 and one for shell ports 42D into the devolatilization zone. Only air distribution means 45 for module M1 is shown in detail in FIG. 1 and will be described, such air distribution means for the other modules being similar to that for module 1. Module 1 has sixty-four shell ports 42G arranged with sixteen shell ports circumferentially spaced apart in each of four radial planes through kiln 10. The four axially spaced shell ports 42G of module M1 disposed in the same portion of the kiln circumference are connected to an air conduit 42 which extends parallel to the kiln axis and has a radially extending L-shaped pipe elbow 46 that registers with the outlet from an off-off valve V. The inlet to on-off valve V is connected to manifold 44 for module M1. Sixteen such on-off valves V are provided for module M1, and each valve V is actuated to the open position when the four associated shell ports 42G registering with the same conduit 43 are beneath bed 37 and a star wheel 48 affixed to and rotating with kiln 10 engage a stationary operating member 50, in a manner similar to that disclosed in aforementioned U.S. Pat. Nos. 4,070,149, 3,945,624 and 3,847,538. Opening of an on-off valve V by a star wheel 48 connects manifold 44 to elbow 46, air conduit 43 and the four associated shell ports 42G so that air from manifold 44 is admitted into the gasifying zone through the associated shell ports 42G beneath bed 37. As represented in FIG. 3, the twelve shell ports 42G associated with three such on-off valves V can be disposed simultaneously within the air flow arc so that all twelve shell ports 42G admit air simultaneously into module 1 underneath bed 37.

A fan 60 driven by an electric motor 61 is affixed to kiln 10 and its outlet is connected to the inlet of a flow rate control valve 63. The outlet from flow rate control valve 63 is connected through a manually adjusted valve 65 and a flexible conduit 67 to manifold 44. Fan 60 provides air to manifold 44 at a pressure regulated by the settings of flow rate control valve 63 and manual valve 65. The position of flow rate control valve 63 varies with the rate that cellulosic material 35 is fed into kiln 10 by conveyor belt 34 and auger 40. FIG. 1 schematically illustrates that a weight belt scale 69 provides an electric analog signal to a feedback control circuit FC indicative of the pounds per hour of cellulosic material 35 fed into kiln 10, and that feedback control circuit FC transmits an electrical control signal to flow rate control valve 63 to change its setting in accordance with the magnitude of such control signal. It will thus be appreciated the air pressure within manifold 44, and the correspondig mass flow rate of air through shell ports 42G of module 1 into the gasifying zone, will be regulated in proportion to the rate that cellulosic material 35 is fed into kiln 10 by conveyor belt 34 and auger 40. Manual valve 65 permits selective variation of air pressure within manifold 44; and similar manual valves 65 in the four modules M1–M4 permit selective variation of the mass air flow rates through shell ports 42G in modules M1, M2, M3 and M4 respectively so that, for example, 40%, 30%, 20% and 10% of the total air admitted into the gasifying zone flows respectively through shell ports 42G in modules M1, M2, M3 and M4. Such percentages of the total amount of air admitted through shell ports 42 in modules M1, M2, M3 and M4 into the gasifying zone are approximately proportional to the relative percentages of carbon in the cellulosic material bed being transported through these modules, as graphically illustrated in FIG. 2, thereby assuring that the air admitted into the gasifying zone is efficiently utilized in converting carbon in the cellulosic material into carbon gases and does not result in excessive temperature rise or entrainment of a substantial amount of solid particulates in the fuel gas.

The embodiments of the invention in which an exclusive property or privilege is claimed are defined as follows:

1. The method of gasifying cellulosic material in a rotary kiln having drying, devolatilization and gasifying zones of successively increasing temperature from the intake end to the discharge end thereof, comprising the steps of:

feeding cellulosic material through said intake end of the kiln into said drying zone, transporting a bed of said cellulosic material through said kiln and continuously tumbling said bed, withdrawing fuel gases generated within said kiln from said intake end so that they flow countercurrent to and in heat exchange relation with the cellulosic material bed and remove moisture therefrom in the drying zone and thermally decompose the volatiles therein in the devolatilization zone, admitting air into the kiln overbed in the devolatilization zone to raise the temperature of said bed and enhance distillation of said volatiles, admitting air into said gasifying zone only beneath said bed to convert the carbon in said cellulosic material into gas, and regulating the mass flow rate of air admitted into said gasifying zone as a function of the rate that said cellulosic material is fed into said kiln wherein said regulating step includes regulating said mass flow rate of air admitted underbed into said gasifying zone so that the resulting gases flowing upward through said bed do not blow a substantial amount of solid particles away from the surface of the bed and entrain them in the overbed gases and wherein said kiln is inclined and said feeding step feeds said cellulosic material into the uphill intake end of said kiln and said transporting step includes rotating said kiln at a velocity such that said bed of cellulosic material occupies a segment of the rotating kiln cross section and is continuously tumbled.

2. The method of gasifying cellulosic material in accordance with claim 1, wherein said regulating step includes regulating the mass flow rate of air admitted overbed into said devolatilization zone as a function of the rate said cellulosic material is fed into said kiln.

3. The method of gasifying cellulosic material in accordance with claim 2 wherein said regulating step includes regulating the mass flow rate of air into said devolatilization zone so that the temperature of the cellulosic material bed exiting from said devolatilization zone and entering said gasifying zone is above its spontaneous ignition temperature.

4. The method of gasifying cellulosic material in accordance with claim 2 wherein said regulating step includes limiting the mass flow rate of air into said gasifying zone to a maximum of approximately 23 percent of that mass flow rate of air which is stoichiometric to the rate said cellulosic material is fed into said kiln.

5. The method of gasifying cellulosic material in accordance with claim 2 wherein said regulating step includes limiting the mass flow rate of total air admitted into said kiln to a maximum of approximately 46 percent of that mass flow rate of air which is stoichiometric to the rate said cellulosic material is fed into said kiln and controlling said mass flow rate of air into said devolatilization and gasifying zones so that they are approximately equal.

6. The method of gasifying cellulosic material in accordance with claim 1, wherein said kiln has plural circumferentially spaced shell ports projecting into said gasifying zone in the interior of the kiln, and said step of admitting air into said gasifying zone includes opening said shell ports when they are beneath said bed and interrupting the flow of air through said shell ports when they are above said bed.

7. The method of gasifying cellulosic material in accordance with claim 6 wherein said bed occupies a segment of the radial cross section through said kiln, and said air admitting step includes opening said shell ports only when they are within an air flow arc angle subtended at the kiln axis which is less than the angle subtended at said axis by said segment of the kiln cross section.

8. The method of gasifying cellulosic material in accordance with claim 6 wherein said shell ports are arranged in sets spaced apart axially of said kiln, and said regulating step includes controlling the mass flow rates of air through said axially spaced sets of shell ports as functions of the percentages of carbon in the cellulosic material in the portions of said gasifying zone wherein said sets are disposed, whereby oxygen in the air admitted into said gasifying zone is efficiently utilized in converting the carbon in said cellulosic material into gas.

9. The method of gasifying cellulosic material in accordance with claim 8 wherein said regulating step includes controlling the mass flow rates of air through said axially spaced sets of shell ports as functions of their distances from the discharge end of the kiln so that said mass flow rate is highest through the most uphill of said sets and decreases progressively through said sets in a direction toward the discharge end of said kiln.

10. The method of gasifying cellulosic material in accordance with claim 6 wherein said regulating step includes controlling the mass flow rate of air through said shell ports so that the maximum superficial velocity of the resulting gases flowing upward through said bed is approximately thirty feet per minute.

11. The method of gasifying cellulosic material in accordance with claim 1 and including initially heating a portion of the cellulosic material within said kiln from an external fuel source to start a self-sustaining combustion reaction in said devolatilization and gasifying zones.

12. The method of continually gasifying cellulosic material in an inclined rotary kiln having drying, devolatilization and gasifying zones of increasing temperature from the intake end to the discharge end thereof and having a plurality of circumferentially spaced shell ports open to the gasifying zone in the interior of said kiln, comprising the steps of:

feeding a continuous supply of said cellulosic material into said drying zone through the uphill intake end of said kiln;

rotating said kiln to form a tumbling bed of said material which occupies a segment of the kiln cross section and advances downwardly through the kiln;

withdrawing fuel gases generated in said kiln from said uphill intake end so that they flow countercurrent to and in heat exchange relation with said bed to dry said material in the drying zone and thermally decompose the volatiles in said material in the devolatilization zone, initially heating said cellulosic material within said kiln from an external source to start a self-sustaining combustion reaction in said devolatilization and gasifying zones, admitting air into said kiln over said bed in the devolatilization zone to support partial combustion of the overbed gases from the gasifying zone and thereby enhance distillation of said volatiles and raise the temperature of said cellulosic material in said bed, admitting air into said gasifying zone through said shell ports only when said shell ports are underneath said bed and interrupting the flow of air through said shell ports when they are above said bed, and regulating the mass flow rate of air through said shell ports into said gasifying zone as a function of the rate said cellulosic material is fed into said kiln and so that the velocity of the resulting gases flowing upward through said bed is insufficient to blow a substantial amount of solid particles away from the surface of said bed.

13. The method of gasifying cellulosic material in accordance with claim 12 wherein said regulating step includes limiting the mass flow rate of air through said shell ports to a maximum of approximately 23 percent of that mass flow rate of air which is stoichiometric to the rate said cellulosic material is fed into said kiln and also includes controlling the mass flow rate of air into said devolatilization zone so that the temperature of the cellulosic material bed exiting said devolatilization zone is above its spontaneous ignition temperature.

14. The method of gasifying cellulosic material in accordance with claim 12 or 13 wherein said kiln has plural axially spaced sets of circumferentially spaced shell ports projecting into said gasifying zone, and said regulating step includes controlling the mass flow rates of air through said axially spaced sets as functions the percentages of carbon in the cellulosic material in the portions of said gasifying zone wherein said sets are disposed.

15. The method of gasifying cellulosic material in accordance with claim 14 wherein said regulating step includes controlling the mass flow rates of air through said axially spaced sets of shell ports as functions of their distances from the discharge end of the kiln so that said mass flow rate is highest through the most uphill of said sets and decreases progressively through said sets in a direction toward the discharge end of said kiln.

* * * * *